US006352292B1

(12) United States Patent
Lindström

(10) Patent No.: US 6,352,292 B1
(45) Date of Patent: Mar. 5, 2002

(54) ARRANGEMENT IN A LIFTING DEVICE

(75) Inventor: Lennart Lindström, Vällingby (SE)

(73) Assignee: Bromma Conquip AB, Vallingby (SE)

( * ) Notice: Subject to any disclaimer, the term of this patent is extended or adjusted under 35 U.S.C. 154(b) by 0 days.

(21) Appl. No.: 09/554,878

(22) PCT Filed: Nov. 19, 1998

(86) PCT No.: PCT/SE98/02098

§ 371 Date: May 22, 2000

§ 102(e) Date: May 22, 2000

(87) PCT Pub. No.: WO99/31003

PCT Pub. Date: Jun. 24, 1999

(30) Foreign Application Priority Data

Nov. 21, 1997 (SE) ..... 9704279

(51) Int. Cl.[7] ..... B66C 1/66; B66C 1/10; B66F 9/18

(52) U.S. Cl. ..... 294/81.21; 294/81.2

(58) Field of Search ..... 294/81.1, 81.2, 294/81.21, 81.54

(56) References Cited

U.S. PATENT DOCUMENTS

| | | | | | |
|---|---|---|---|---|---|
| 3,273,931 | A | * | 9/1966 | Caldwell et al. | 294/81.2 |
| 3,536,350 | A | * | 10/1970 | Backteman | 294/81.21 |
| 3,752,346 | A | * | 8/1973 | Thompson et al. | 294/81.21 |
| 3,788,680 | A | * | 1/1974 | Brown | 294/81.21 |
| 3,992,050 | A | * | 11/1976 | Backteman | 294/81.21 |
| 4,462,627 | A | * | 7/1984 | Kudlicka | 294/81.21 |
| 4,471,989 | A | | 9/1984 | Taylor | 294/81.21 |
| 4,595,224 | A | * | 6/1986 | Kaup | 294/81.2 |
| 5,052,734 | A | * | 10/1991 | Hasegawa et al. | 294/81.2 |
| 5,354,112 | A | * | 10/1994 | Hara et al. | 294/81.2 |
| 5,630,635 | A | * | 5/1997 | Karlsson | 294/81.21 |
| 5,630,636 | A | * | 5/1997 | Karlsson | 294/81.21 |
| 6,138,846 | A | * | 10/2000 | Baumann | 294/81.21 |

FOREIGN PATENT DOCUMENTS

| | | | | |
|---|---|---|---|---|
| DE | 2055749 | * | 3/1981 | 294/81.21 |
| DE | 4118524 | * | 12/1992 | 294/81.21 |
| EP | 0 055 874 | | 7/1982 | |
| EP | 370585 | * | 5/1990 | 294/81.21 |
| SU | 1752707 | * | 8/1992 | 294/81.21 |

* cited by examiner

*Primary Examiner*—Eileen D. Lillis
*Assistant Examiner*—Paul T. Chin
(74) *Attorney, Agent, or Firm*—Young & Thompson

(57) ABSTRACT

An arrangement for a spreader for hoisting containers includes a beam extendable from a retracted position in a housing to an extended position. An additional beam member is received in an inner end of the extendable beam and is arranged to slide axially with respect to the extendable beam, as well as with respect to the housing. An interlocking device is arranged on the extendable beam and on the additional beam member. The interlocking device transfers an extension motion from the extendable beam to the additional beam member. A device arranged on the additional beam member as well as the housing acts to limit the relative axial motion of the additional beam member with respect to the housing. The additional beam member provides an inner end extension of the extendable beam when the additional beam member is extended to engage the device of the housing.

4 Claims, 2 Drawing Sheets

V-V

ARRANGEMENT IN A LIFTING DEVICE

BACKGROUND OF THE INVENTION

The present invention relates to arrangements in lifting devices, and particularly to an arrangement which provides an improvement of the operational capacity of a so-called spreader, designed for lifting a goods-container.

DESCRIPTION OF THE RELATED ART

For the purpose of loading and re-loading in container transport, various types of lifting devices exist, for example, the type from which a rails-bound or wheel-supported crane is lowered over a container to engage with its corner fittings during a lift from a vessel to a dock, for example. The present invention is aimed at improving the operational capacity of such lifting devices, commonly referred to as spreaders. The following disclosure relates to a design comprising a central housing body in which two or several beams are accommodated for telescoping and oppositely directed relative movements. The beams have at their outer ends a pair of coupling means for engaging with the corner fittings, and are driven hydraulically or electrically to extend or retract, respectively, to adapt to the container's length. The driving means and the movement-transmitting means are arranged in or on the housing body, which is suspended by the cables of the crane or positioned at the end of the beam of the crane.

The handling of containers is a constantly developing activity, and continuous adaptation of current technique is required to fill the needs of the transport market. In the technical field there are containers of various standardised lengths of 20, 30, 40 and 45 feet. Because of the demands for rational and cost-saving goods handling, a growing need has arisen to handle containers also of greater lengths, for example 48, 53 feet, etc. in docks and goods terminals. Thus, there is a need for spreaders which have great flexibility and a capacity to handle containers of greater lengths so as to avoid set up time for changing lifting arrangements.

The technical solutions to accommodate the above mentioned requirements are limited, among other things since the length of the center housing body shall permit retraction also to allow the containers, having the shortest lengths, to be lifted. Other restrictions reside in the total weight of the spreader and the position of a coupling member at the outer end of the spreader beam. These limitations cause problems when designing an arrangement wherein the opposite ends of the beams are moved to pass each other or to overlap in the retracted end position of the beams. One previous solution to these problems comprises hydraulic, telescopic beams of conventional type in two or more sections.

SUMMARY OF THE INVENTION

The present invention is aimed at providing an alternative, cost-saving solution to the above stated problems by providing a spreader, comprising a central housing, wherein at least two beams are stored in parallel and which project and retract in opposite directions, respectively. Said spreader, on each respective beam, has an axially moveable, additional beam member, acting as an extension of the beam when the beam is projected, and when the beam is in retracted position is designed to rest in an overlapping position on the beam.

BRIEF DESCRIPTION OF THE DRAWINGS

This object is achieved by an arrangement according to the attached claim 1, and embodiments of the invention are stated in the subsequent claims.

Embodiments of the invention are described in more detail below and refer to the enclosed drawings, wherein.

DESCRIPTION OF THE PREFERRED EMBODIMENTS

Figures 1, 2, 3, 4, 5:
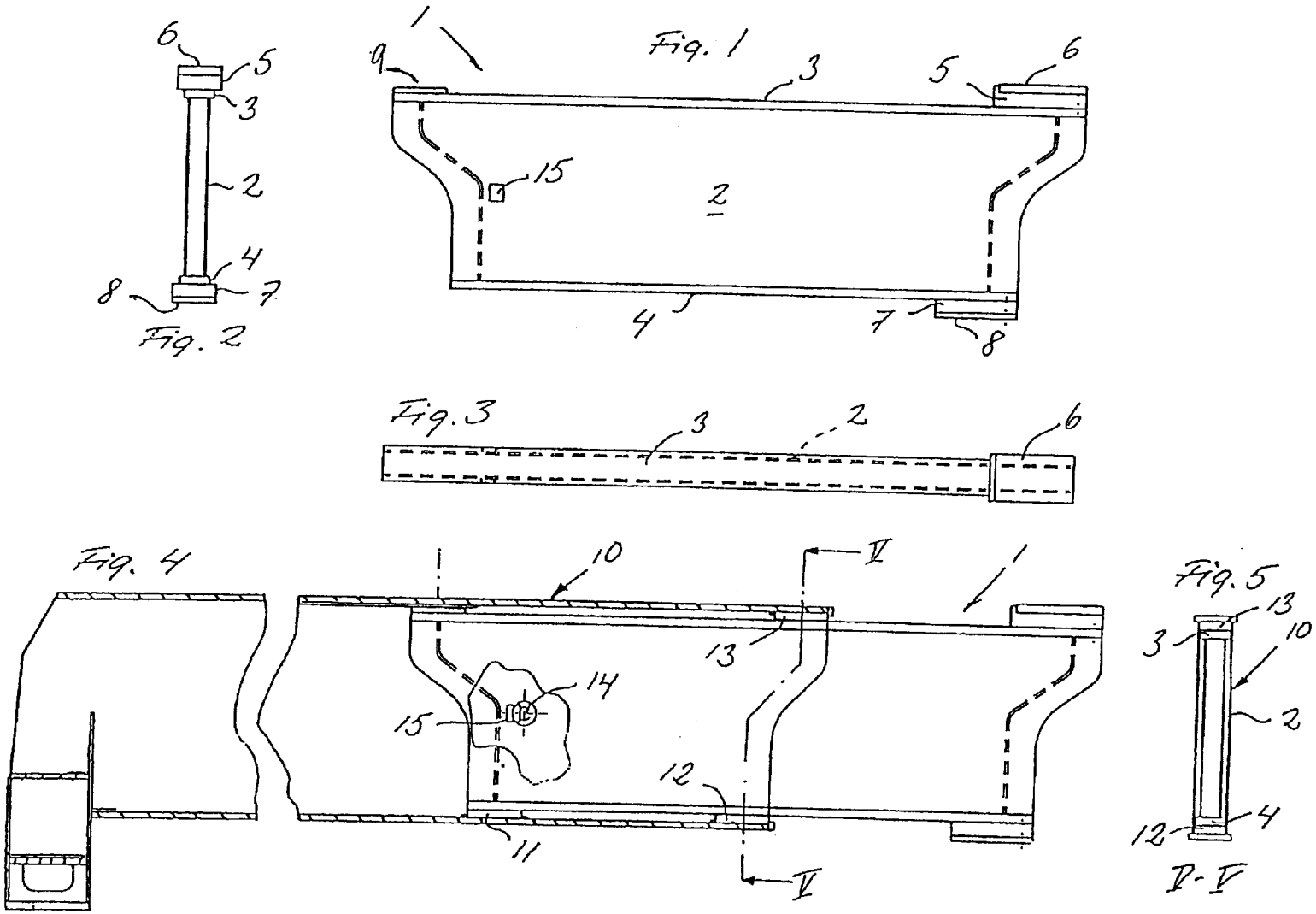
FIG. 1 is a vertical side view of a beam member according to the invention.
FIG. 2 is an end view of the beam member in FIG. 1.
FIG. 3 is a top plan view of the beam member in FIG. 1 and FIG. 2.
FIG. 4 is a partially broken, cross sectional view of the beam member according to the invention attached to a beam of a spreader.
FIG. 5 is a cross sectional view along the line V—V in FIG. 4.

In FIGS. 1, 2 and 3 an illustrating embodiment of the invention is shown, comprising an essentially I-formed beam member 1, having a body 2 and an upper and lower longitudinal plate 3 and 4, respectively.

The end profiles of the beam member 1 are formed to adapt to the spreader's overall design so as to take advantage of the available standing space in a box body, not shown in FIG. 1. The end profiles are not critical for the technical effect of the invention but can be given any suitable design for each adaptation, therefor these are not described in detail.

On the upper side of the upper plate 3, there is a spacing block 5 arranged at one end of the beam member 1. Above the spacing block is a sliding member 6. Likewise, on the underside of the plate 4, a spacing block 7 having a sliding member 8 placed on the under side, is arranged at the same end of the beam member 1. The upper spacing block 5 comprises a stop bolt for restricting the motion of the beam member in a manner disclosed more closely below, with reference to FIG. 6. At the opposite end of the beam member 1 a sliding member 9 is arranged on the upper side of the upper plate 3.

FIG. 4 is a partially broken cross sectional view of a beam 10, in a spreader designed for lifting containers. The beam 10 is formed as a box, at one end of which, hereinafter referred to as its inner end, a beam member 1 is introduced by slip fitting to allow axial motion in relation to the beam 10. Presented for comparison is FIG. 5, which illustrates a cross sectional view along the line V—V in FIG. 4. The sliding members 11, 12 and 13 may be arranged internally in the beam 10 to facilitate movement of the beam member 1 in the beam 10, and are of a material selected to cope with the heavy loads involved. As examples of suitable materials for the sliding members, metal, rubber or synthetic material, can be mentioned, optionally a mixture of these and having self-lubricating properties.

Internally, on one of the vertical sides of the beam 10 (in FIG. 4, broken off) a heel 14 is arranged in the space between the beam member's body 2 and the inside of the beam 10. The heel 14 engages with the stop bolt 15 (cf. also FIG. 1) on the body 2 of the beam member, to ensure, on projection of the beam 10 out of the housing body, that the beam member 1 follows the movement. It can be seen that the beam member 1 is axially movable in relation to the beam 10 and that the motion of the beam member is restricted by the spacing blocks 5 and 15 in a manner which, in part, is described above and, in part, is described below in connection with FIGS. 6 and 7.

Without it being specifically shown, it is mentioned here that instead of the heel 14 and the spacing block 15, engagement members of other design can be arranged between the beam 10 and the beam member 1 to bring it into movement. Furthermore, the beam member can be provided with a driving means, such as a piston/cylinder unit, acting either between the beam member and the box body 1, or between the beam member and the beam 10, for controlling the beam member's movement. In a preferred embodiment, however, the beam member 1 is freely axially movable on the beam 10 so as to be brought into its projection or retraction, respectively.

The beam 10 at its other end, or outer end, is arranged to accommodate conventional coupling means, not shown, for coupling the spreader having the device according to the invention to the corner fittings of a container.

Figure 6:
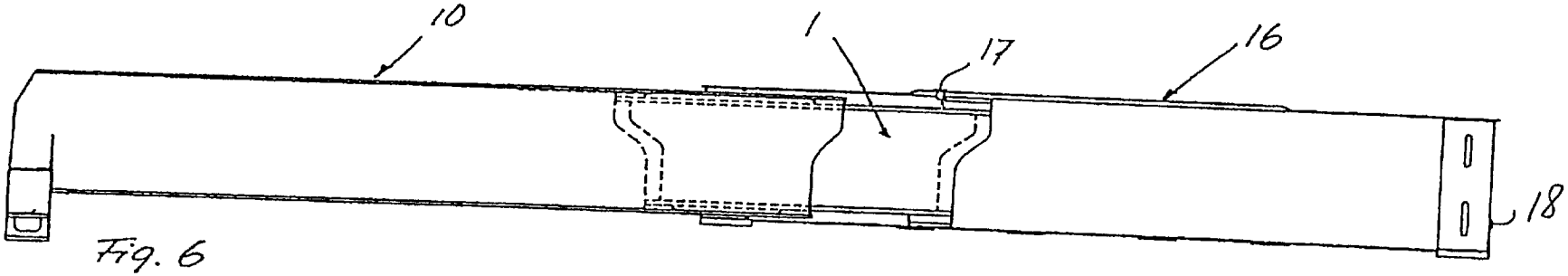
FIG. 6 is a schematic view of the beam and the beam member in FIG. 4, attached in a housing body of a spreader and in a projected end position.

FIG. 6 illustrates schematically the beam 10 with the beam member 1 accommodated for outward and return movement in the housing body 16 of a spreader, in an outer end position. The beam 10 is carried for sliding motion in the housing body 16, optionally with the aid of friction plates or pressure plates, and for projection and retraction, respectively, is driven by hydraulic, electrical or mechanical drive means and movement transferring means such as rods, endless chains or wires. The driving means are not crucial to the concept of the invention and several conventional methods are to be found in prior art on how to generate the movement of the beam 10 in the housing body 16. Therefore, for the sake of clarity, the driving and movement transferring means have been left out on the drawings. For the same reason the fastenings for crane lines or for a crane beam, which are generally arranged on the upper side of the housing body 16, have not been shown either.

In the outer end position, as illustrated in FIG. 6, the beam member 1 has been brought by beam 10 into a position where the stop block 5 is at a standstill and lies against a heel 17 which juts down from the top side of the housing body 16 into the storing space of the beam to a depth which allows the beam 10 to pass the heel 17 on its retraction from the illustrated end position. For guidance of the beam 10 in the housing body 16 the beam member's spacing block/stop bolt 5 protrudes upwards with the sliding member 6 over the outer surface of the beam 10, to lie against the upper, horizontal inner side of the storing space. In the same manner the beam member's spacing block 7 juts down with the sliding member 8 below the under side of the beam 10, to lie against the lower, horizontal inner side of the storing space. In this manner an undesired drawer effect may be avoided and a problem-free movement of the beam 10 together with the beam member 1 may be carried out in the housing body 16.

Figure 7:
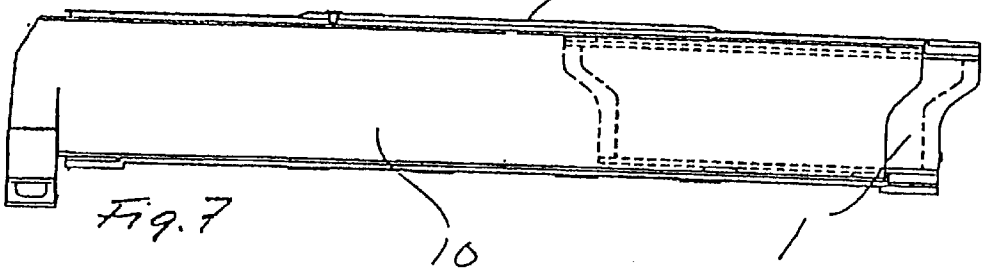
FIG. 7 is a schematic view of the beam and the beam member in FIG. 6 in a retracted end position in the housing body.

FIG. 7 illustrates schematically the beam 10 with the beam member 1 in a retracted position or end position in the housing body 16. On retraction of the beam 10, the beam member 1 is carried along by the upper edge of the inner end of the beam 10 which is designed to engage the stop block 5 and to push the beam member 1 forward. A stop heel 18 may be arranged on the box body 16 to define a definite end position for the retraction movement and to prevent the beam member 1 from hitting and damaging constructive elements of the beam/beams, carried in a parallel manner and axially moveable in mutual opposite direction and with coupling means for engaging with the corner fittings of a container.

When studying FIG. 6, it may easily be seen that the arrangement according to the invention provides a simple and cost-saving technical solution to the problem of improving the operational capacity of a spreader designed for hoisting containers. By still retaining the length of the box shaped body, a spreader will be able to adjust for lifts of container lengths of 20', at the same time as additional extending length is provided for lifting container lengths of 48' or more. By means of the storing of the beam member 1 over the beam 10, necessary engagement lengths are achieved from the box body 16 for carrying out safe lifts by acceptable stress at engagement points, and by means of the free movement of the beam members in relation to the beam 10, a cost-saving design without extra driving or power requirements is achieved.

The invention here has been described in connection to a spreader comprising at least two side-by-side carried, in mutual opposite direction extendable, retractable, respectively, beams 10. The scope of invention is obviously also applicable to spreaders which have four, in pairs, axially moveable beams, operated synchronically or non-synchronically in their movement.

What is claimed is:

1. Arrangement on a spreader for hoisting containers, wherein a beam (10) is extendable from a retracted position in a housing (16) to an extended position, the beam having an outer end and an inner end, comprising:

an additional beam member (1) received in the inner end of the extendable beam for axial sliding motion relative thereto, and relative to the housing;

interlocking means (14, 15) arranged on the extendable beam and on the additional beam member for transferring the extension motion from the extendable beam (10) to the additional beam member (1);

stop means (5, 17) arranged on the additional beam member and on the housing, respectively, for limitation of the relative axial motion between the additional beam member (1) and the housing (16), such that the additional beam member provides an inner end extension of the extendable beam when the additional beam member is brought in the extension motion of the extendable beam to engage said stop means (17) of the housing.

2. The arrangement of claim 1, wherein the extendable beam (10) has a box section receiving the additional beam member (1) for axially sliding motion in the inner end thereof, the additional beam member having an I-section and said interlocking means (14, 15) being arranged to project into a space that is defined between the box section of the extendable beam and the I-section of the additional beam member, the interlocking means being formed to engage only upon extension of the extendable beam (10) for bringing the additional beam member (1) in the extension motion of the extendable beam (10).

3. The arrangement of claim 1, wherein the interlocking means (14, 15) are formed to disengage upon retraction motion of the extendable beam (10), the extendable beam being guided (9, 10, 11, 12) for sliding motion on the additional beam member (1), the additional beam member being guided (6, 8) for sliding motion in the housing (16), and the inner end of the extendable beam bringing the additional beam member (1) in the retraction motion of the extendable beam (10) to be substantially fully overlapped by the extendable beam in its retracted position in the housing.

4. The arrangement of claim 1, wherein the additional beam member (1) forms an inner end extension of the extendable beam (10) which is freely axially movable relative to the extendable beam to an axial length defined through said interlocking means (14, 15) and said stop means (5).

* * * * *